US007181340B2

(12) United States Patent
Endo

(10) Patent No.: US 7,181,340 B2
(45) Date of Patent: Feb. 20, 2007

(54) ENGINE CONTROL CIRCUIT

(75) Inventor: Hitoshi Endo, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 11/151,430

(22) Filed: Jun. 14, 2005

(65) Prior Publication Data

US 2005/0283304 A1 Dec. 22, 2005

(30) Foreign Application Priority Data

Jun. 21, 2004 (JP) ..... 2004-182045

(51) Int. Cl.
*F02D 45/00* (2006.01)

(52) U.S. Cl. ..... 701/114

(58) Field of Classification Search ..... None
See application file for complete search history.

(56) References Cited

U.S. PATENT DOCUMENTS 5,095,438 A 3/1992 Sasaki 6,999,867 B2 * 2/2006 Konno ..... 701/102

FOREIGN PATENT DOCUMENTS

| | | |
|---|---|---|
| JP | 62-258154 | 11/1987 |
| JP | 07-042888 | 5/1995 |
| JP | 07-114401 | 5/1995 |

* cited by examiner

*Primary Examiner*—Andrew M. Dolinar
(74) *Attorney, Agent, or Firm*—Nixon Peabody LLP; Donald R. Studebaker

(57) ABSTRACT

An engine control circuit includes a battery voltage detector, a signal supervisor, and a processor that operates in a normal mode and a power-down mode. The battery voltage detector senses the output voltage of a battery that supplies current to the engine, and asserts a detection signal when the voltage is below a predetermined value. The signal supervisor measures the length of time for which the detection signal remains asserted. The processor switches from the normal mode to the power-down mode when the measured length of time reaches a predetermined value. This scheme avoids loss of engine control when the battery voltage drops briefly and then recovers.

7 Claims, 4 Drawing Sheets

ENGINE CONTROL CIRCUIT

BACKGROUND OF THE INVENTION

1. Field of the Invention

The present invention relates to an engine control circuit that uses a processor to control the operation of an engine, more particularly to the prevention of a certain type of malfunction of the engine control circuit.

2. Description of the Related Art

Automobile engine control by means of a system including a processor such as a microcomputer is a known art: the system is generally referred to as an electronic control unit and more specifically as an engine control unit (ECU). ECUs having a power-down mode are also known: in the power-down mode, the ECU stops controlling the engine, and the ECU's power consumption is reduced to the minimum level necessary to retain the data stored in its random-access memory (RAM). The power source of an ECU is a regulator that draws current from the automobile's battery and converts the battery voltage to the voltage required by the ECU. Battery charge can be conserved by placing the ECU in the power-down mode while the engine is not running. A voltage detector in the ECU detects the voltage supplied to the igniter (the device that controls the engine's ignition) to decide whether the engine is running or not.

With such a voltage detector, however, there is the risk of a malfunction when the battery voltage drops rapidly. This is because, like the other circuits in the ECU, the voltage detector is supplied with power at a voltage converted from the battery voltage. Consequently, when the battery voltage drops rapidly, the power supply voltage of the voltage detector also drops, and this may cause the voltage detector to misjudge the battery voltage by deciding that the battery voltage is lower than it actually is. If the voltage detector detects a voltage lower than a predetermined threshold voltage, then even though the engine is still running, the ECU will decide that the engine has stopped and will enter the power-down mode. After entering the power-down mode, the ECU cannot control the igniter, so the engine actually does stop, unexpectedly.

The voltage of an automobile's battery drops, for example, when the engine is started. The cranking operation performed to start the engine places a maximum load on the starter motor, causing the output voltage of the battery to drop temporarily. The cranking operation takes place when the ignition switch is turned on by the automobile's ignition key, causing the starter motor to rotate and forcing the engine shaft to turn. A twelve-volt (12-V) battery, for example, has an open voltage of about thirteen volts (13 V), but this voltage drops to about nine volts (9 V) when the engine is started and then gradually increases to a stable value of about fourteen volts (14 V). A time of about one second elapses from when cranking starts until the battery voltage becomes stable.

The sudden temporary drop of the battery voltage when the engine is started becomes increasingly pronounced at low air temperatures. This is because a lowered air temperature increases the viscosity of the engine oil, thereby increasing the load on the engine shaft and accordingly the load on the starter motor.

Sporadic voltage drops, which are unlikely in a new battery, may also occur when the battery is degraded by age.

The regulator mentioned above can keep the ECU's power supply voltage steady as long as the battery voltage changes slowly. Since the regulator has a transient response time, however, it cannot follow rapid battery voltage changes, and may allow the ECU power supply voltage to drop for a period of, for example, about one millisecond.

One method of preventing temporary drops of the battery voltage is to use an auxiliary battery, for example, or a charged capacitor to compensate for the voltage drop, but this method does not fully prevent temporary voltage drops of the kind described above.

Other technology for preventing ECU malfunctions is disclosed in, for example, Japanese Patent Application Publication Nos. S62-258154 and H07-114401 and Japanese Patent No. H07-42888.

Japanese Patent Application Publication No. H07-114401 discloses an ECU that enters a power-down mode but retains its RAM data when the battery voltage drops below a predetermined voltage V1, and resets its central processing unit (CPU) when the battery voltage drops below a lower predetermined voltage V2. This first conventional scheme avoids such problems as loss of RAM data and CPU runaway when the battery voltage falls into the region between voltages V1 and V2, but does not prevent the battery voltage from being detected incorrectly when it drops suddenly. A sudden drop to a voltage slightly above V1 may still be detected as a drop to a voltage below V1, causing the ECU to power down and the engine to stop unexpectedly as described above.

Japanese Patent No. H07-42888 discloses an ECU that resets its CPU without resetting its RAM data when the battery voltage drops temporarily due to engine start-up. This second conventional scheme also avoids the problems of RAM data loss and CPU runaway when the battery voltage drops, but the ECU does not have a power-down mode. The ECU therefore cannot conserve battery charge by powering down when the engine is stopped, and the problems caused by mistaken entry into the power-down mode are not addressed.

Japanese Patent Application Publication No. S62-258154 discloses an ECU that, when the battery voltage drops temporarily, first inhibits the writing and reading of RAM data, then resets the CPU. Like the second scheme above, this third scheme avoids the problems of RAM data loss and CPU runaway when the battery voltage drops, but also as in the second scheme, the ECU does not have a power-down mode, so it cannot conserve battery charge by powering down when the engine is stopped, and the problems caused by mistaken entry into the power-down mode are not addressed.

SUMMARY OF THE INVENTION

An object of the present invention is to provide an engine control circuit that has a power-down mode but will not enter the power-down mode by mistake when the battery voltage dross temporarily.

The invented engine control circuit controls an engine that receives current from a battery. The engine control circuit operates in a normal mode and a power-down mode, switching between these modes according to the battery voltage output by the battery.

The engine control circuit includes a battery voltage detector, a signal supervisor, and a processor. The battery voltage detector sets a detection signal to the active level when the battery voltage falls below a predetermined value. The signal supervisor measures an interval of time for which the detection signal remains at the active level. The processor switches to the power-down mode when the interval of time measured by the signal supervisor reaches a predetermined length.

Accordingly, the processor in the engine control circuit does not enter the power-down mode by mistake if the battery voltage drops temporarily below the predetermined value but recovers before the elapse of the predetermined length of time.

DETAILED DESCRIPTION OF THE INVENTION

Figure 1:
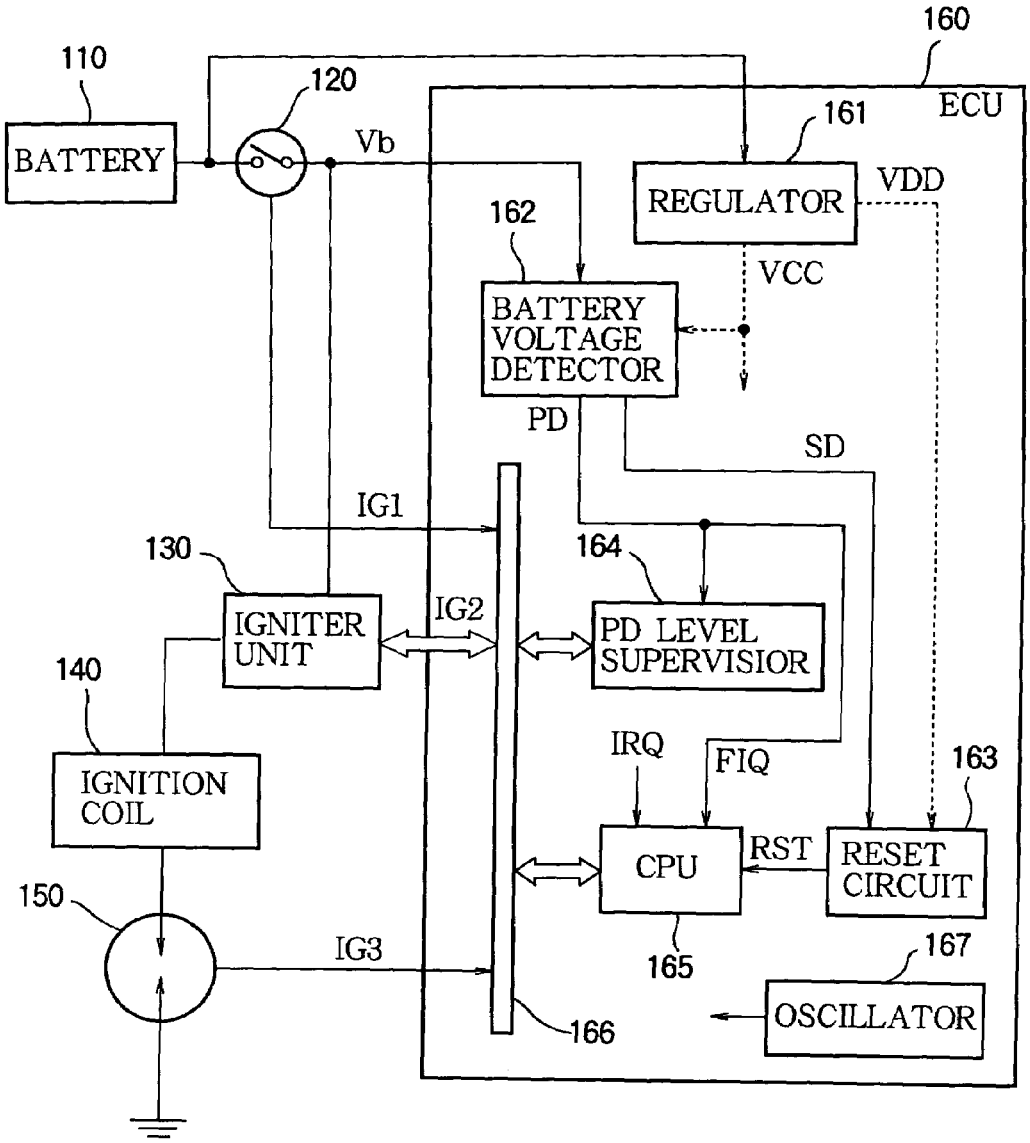
FIG. 1 is a schematic block diagram of an engine control system according to a first embodiment of the invention.

Embodiments of the invention will now be described with reference to the attached drawings, in which like elements are indicated by like reference characters.

First Embodiment

Referring to FIG. 1, the engine control system in the first embodiment includes a battery 110, an ignition switch 120, an igniter unit 130, an ignition coil 140, a distributor and igniter 150, and an ECU 160.

The battery 110 is an ordinary automobile battery with an output voltage of, for example, twelve volts (12 V).

The ignition switch 120 is a switch that supplies power from the battery 110 at the battery voltage Vb to the igniter unit 130. The ignition switch 120 also has a position for activating the starter motor. The status of the ignition switch 120 is sent to the ECU 160 as a signal IG1.

The igniter unit 130 supplies power to the ignition coil 140 when a signal IG2 input from the ECU 160 is at the active level.

The ignition coil 140 converts the input voltage from the igniter unit 130 to a high voltage for igniting the spark plugs (not shown).

The distributor and igniter 150 includes a single distributor and a plurality of igniters. The distributor receives the high voltage from the ignition coil 140 and supplies it to each of the igniters at a predetermined timing. Each igniter controls the ignition of the spark plug in a corresponding cylinder. The operating status of the distributor and igniter 150 is sent to the ECU 160 as a signal IG3.

The ECU 160 operates in a normal mode when the ignition switch 120 is on, and in a power-down mode when the ignition switch 120 is off. In the normal mode, the ECU 160 controls the igniter unit 130 and other circuits according to information indicating the operating status of the engine (not shown) received from various sensors (not shown). In the power-down mode, the ECU 160 carries out only a minimum level of operations, including retaining data and monitoring the IG1 signal. The ECU 160 comprises a regulator 161, a battery voltage detector 162, a reset circuit 163, a power-down signal (PD) level supervisor 164, a CPU 165, an internal bus 166, and an oscillator 167.

The regulator 161 comprises, for example, a direct-current-to-direct-current (DC-DC) converter. In the normal mode, the regulator 161 converts a voltage (for example, 12 V) supplied from the battery 110 to a pair of power supply voltages VDD (for example, 3.3 V) and VCC (for example, 5 V). VDD is supplied to, for example, the reset circuit 163. VCC is supplied to other circuit blocks: for example, the battery voltage detector 162, PD level supervisor 164, and CPU 165. In the power-down mode, the regulator 161 stops supplying power to some of these circuits.

The battery voltage detector 162 detects the battery voltage Vb supplied through the ignition switch 120 to the igniter unit 130 by comparing it with two predetermined values V0 and V1. When the battery voltage Vb is detected as being equal to or less than the first predetermined value V0, a power-down (PD) signal is set to the active level. When Vb is detected as being equal to or less then the second predetermined value V1 (where V1<V0), a shutdown (SD) signal is set to the active level. As noted above, the battery voltage detector 162 is powered by the VCC power supply voltage generated by the regulator 161.

The reset circuit 163 receives the SD signal from the battery voltage detector 162 and outputs a reset signal RST when the SD signal becomes active.

The PD level supervisor 164 receives the PD signal from the battery voltage detector 162 and measures an interval of time for which the PD signal remains at the active level, by using a timer (not shown). If the interval of time exceeds a predetermined length T3, the PD level supervisor 164 sets an internal PD supervisory flag (not shown).

The CPU 165 switches the operating mode to the power-down mode when the time measured by the PD level supervisor 164 reaches a predetermined length. The CPU 165 receives information indicating the status of the engine and the like from the processor signals IG1, IG3 and various sensors (not shown), stores the information in an internal random access memory (RAM) (not shown), and controls the igniter unit 130 and other circuits according to this information. When the CPU 165 receives the reset signal RST from the reset circuit 163, it resets all of its operations, including the storing of data in the RAM. The CPU 165 also receives the PD signal at its fast interrupt request (FIQ) terminal. FIQ is one of two types of interrupt signals that the CPU 165 (and such processors in general) can accept, the other type being a general-purpose interrupt request (IRQ). IRQ input generates a software interrupt, which is not necessarily served in real time, and is used to control, for example, cabin illumination and the windshield wipers. In contrast, FIQ input generates a hardware interrupt that is always served in real time. In this embodiment, FIQ is used as a trigger signal to decide whether to enter the power-down mode from the normal mode, as will be described later.

The internal bus 166 is a signal bus used for sending signals from the ignition switch 120, igniter unit 130, distributor and igniter 150, and PD level supervisor 164 to the CPU 165, and from the CPU 165 to the igniter unit 130.

The oscillator 167 generates and outputs a clock signal XTAL, which is converted to a system clock by a circuit not shown and distributed to circuits 162 to 165 in the ECU, and to other circuits.

Figure 2:
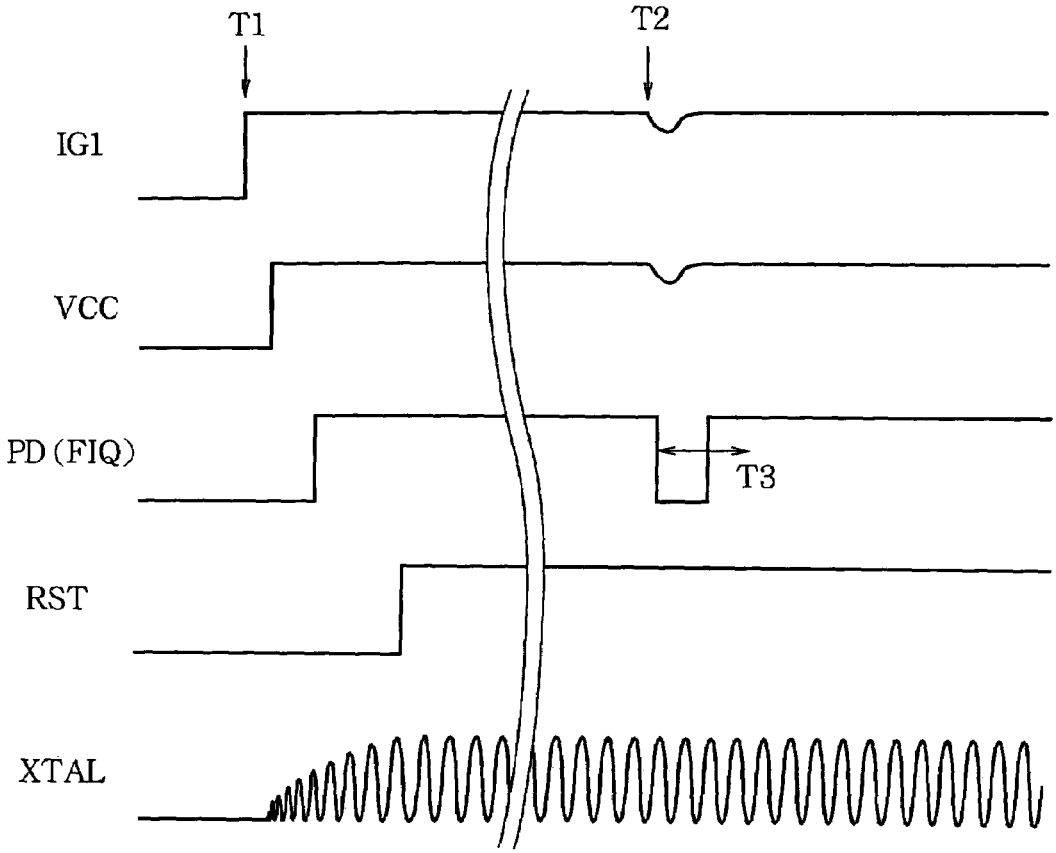
FIG. 2 is a timing diagram illustrating the operation of the first embodiment.

Next, the operation of the ECU 160 in FIG. 1 will be described with reference to the timing diagram in FIG. 2.

Until the ignition switch 120 is turned on, the ECU 160 operates in the power-down mode and the CPU 165 carries out only limited operations, such as retaining the data in the internal RAM and checking the IG1 signal, other operations being halted. The regulator 161 does not supply the power supply voltages VCC and VDD to the battery voltage detector 162, reset circuit 163, PD level supervisor 164, oscillator 167, and other circuits, so the operations of these circuit blocks are also halted. Accordingly, output of the PD and RST signals and the clock signal XTAL is also stopped. Alternatively, instead of stopping clock output completely, the oscillator 167 may be allowed to output a clock signal with a lower frequency.

Under these conditions, when the operator turns on the ignition switch 120 (see T1 in FIG. 2), the IG1 signal, which indicates whether the ignition switch 120 has been closed, goes high, and is sent to the CPU 165 via the internal bus 166. Upon receiving the high level of the IG1 signal, the CPU 165 switches the operating mode of the ECU 160 from the power-down mode to the normal mode. Upon entering the normal mode, the regulator 161 starts supplying the power supply voltages VCC and VDD to the battery voltage detector 162, reset circuit 163, PD level supervisor 164, oscillator 167, and other circuits.

When the battery voltage detector 162 is supplied with the VCC power supply voltage, it starts its detection operation. At this point, since the ignition switch 120 is on, the PD signal is at its inactive level (high). The oscillator 167 starts to output the clock signal XTAL.

After the elapse of a predetermined time from when the oscillator 167 starts operating (during which time the oscillation frequency of the clock XTAL becomes fully stable), the reset signal RST output by the reset circuit 163 goes high. The ECU 160 is thereby released from the reset state and starts normal operations.

When the ignition switch 120 is turned on, the operation of the starter motor (cranking) also begins. After the elapse of a certain time from when the starter motor starts to operate, the load on the starter motor reaches a maximum, and the battery voltage Vb drops rapidly. The elapse of time from when the ignition switch 120 is turned on until the voltage drop begins (at time T2 in FIG. 2) is much longer than the time required for the ECU 160 to enter the normal mode. This is because cranking is a mechanical operation of the starter motor, which proceeds much more slowly than the electronic operation of the ECU.

When cranking starts and the voltage Vb supplied through the ignition switch 120 to the igniter unit 130 drops, the power supply voltage VCC generated by the regulator 161 also drops temporarily. When VCC drops, the battery voltage detector 162 detects the battery voltage Vb as being lower than its actual value. Accordingly, although the battery voltage Vb drops only moderately due to cranking, the battery voltage detector 162 detects a more severe voltage drop. Whenever the detected voltage drop goes below the first predetermined value (V0), the battery voltage detector 162 decides that the engine (not shown) has stopped and sets the PD signal to the active level. Therefore, if the voltage drop due to cranking is large enough, the battery voltage detector 162 may set the PD signal to the active level (low) even though the engine is not stopped.

When activated in this way because of the combined drop of the battery voltage Vb and power supply voltage VCC, the PD signal is normally deactivated quickly, because the regulator 161 quickly restores the power supply voltage VCC to the normal level. If cranking is completed very quickly, the PD signal may also return to the inactive level (high) because the battery voltage Vb has returned to the normal level.

The PD signal is input to the PD level supervisor 164 and CPU 165. When the PD signal is set to the active level, the PD level supervisor 164 measures the interval of time for which the PD signal remains at the active level, by using an internal timer (not shown). If this interval of time exceeds a predetermined length T3 (for example, 30 milliseconds), the PD level supervisor 164 sets the internal PD supervisory flag to the logical "1" level (high). If the PD signal returns to the inactive level within the predetermined length of time T3, then the PD level supervisor 164 stops the timer without setting the PD supervisory flag. In the example shown in FIG. 2, since the battery voltage drop is a momentary drop caused by cranking, the interval of time for which the PD signal remains active is very short, and the timer is stopped before the PD supervisory flag is set. In contrast, when the battery voltage drops because the ignition switch 120 is turned off, the PD signal remains at the active level indefinitely, and the PD level supervisor 164 sets the PD supervisory flag to logical "1" when the predetermined length T3 has elapsed.

The CPU 165 receives the PD signal at the FIQ terminal, and reads the PD supervisory flag value from the PD level supervisor 164 when the FIQ terminal goes to the active level. If the flag value is a logical "1", the CPU 165 decides that the engine has been stopped and switches the operating mode of the ECU 160 to the power-down mode. If the flag value is a logical "0", the ECU 160 remains in the normal mode. In the example shown in FIG. 2, since the PD supervisory flag is not set, the ECU 160 does not enter the power-down mode.

As described above, FIQ is a hardware interrupt that is served in real time. While the input signal voltage at the FIQ terminal is at the active level, the CPU 165 repeatedly checks the PD supervisory flag. If the PD level supervisor 164 sets the flag value to logical "1", the CPU 165 immediately switches over to the power-down mode of operation. If the PD signal (the FIQ input) returns to the inactive level while the flag value remains at logical "0", the CPU 165 terminates the interrupt processing while continuing to operate in the normal mode.

As described above, when the ignition switch 120 is turned off to stop the engine, since the PD signal is kept at the active level, after the elapse of time T3 the PD supervisory flag in the PD level supervisor 164 is set to logical "1" and the CPU 165 switches over to the power-down mode of operation. In contrast, when the PD signal temporarily becomes active due to cranking, the PD signal normally returns to the inactive mode before the PD supervisory flag is set, so the CPU 165 stays in the normal mode.

Accordingly, the first embodiment provides an ECU 160 that will not enter the power-down mode by mistake when the battery voltage drops temporarily.

In a variation of the first embodiment, the crank (not shown) or distributor is provided with an angle sensor and the start of cranking is detected by a rotation angle measurement. The CPU uses this information together with the PD signal and PD supervisory flag to decide when to switch to the power-down mode.

Second Embodiment

Next, a second embodiment of the invention will be described with reference to FIGS. 3 and 4.

Figure 3:
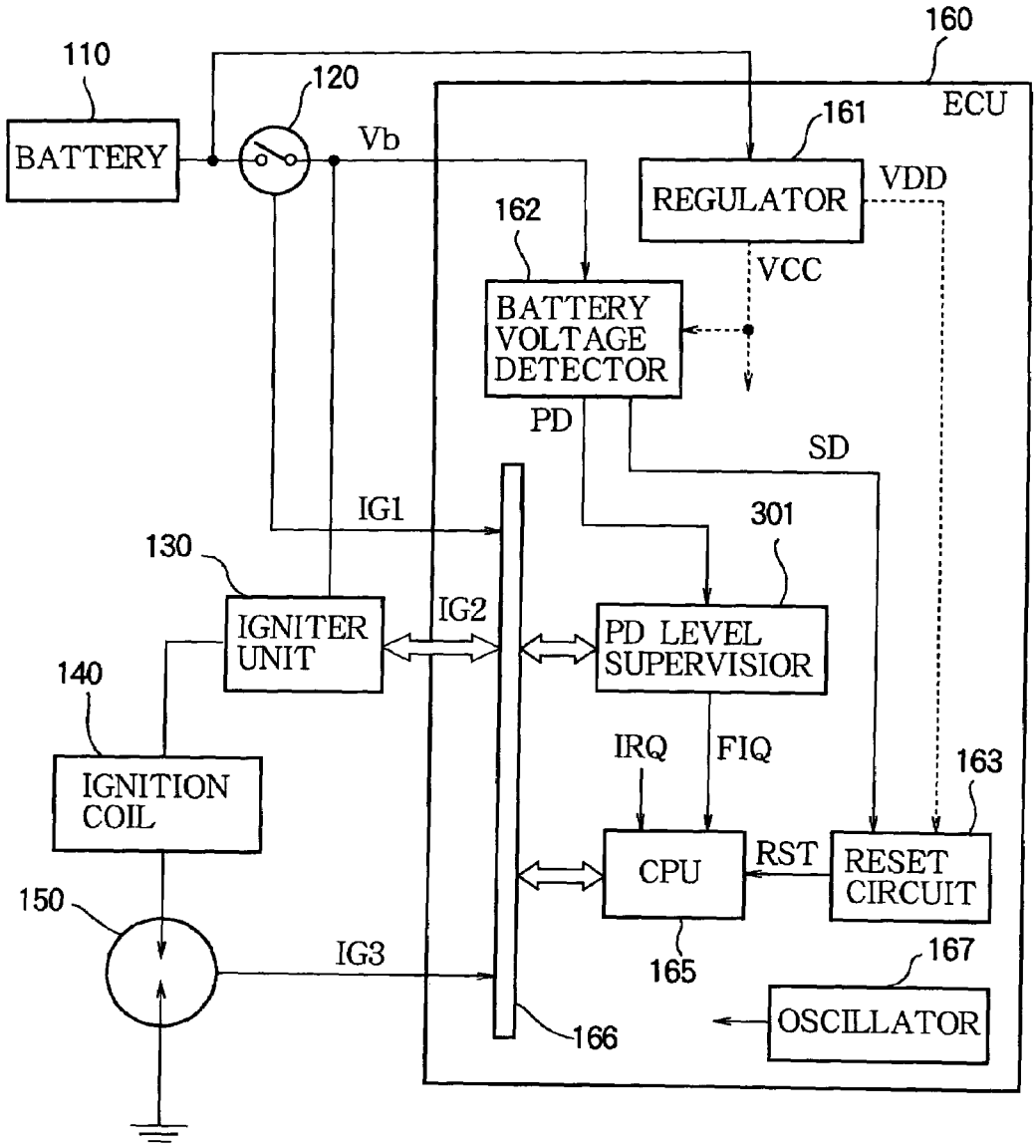
FIG. 3 is a schematic block diagram of an engine control system according to a second embodiment of the invention.

Referring to FIG. 3, the engine control system in the second embodiment has a PD level supervisor 301 different from the PD level supervisor in the first embodiment.

The PD level supervisor 301 receives the PD signal from the battery voltage detector 162 and measures the interval of time for which the PD signal remains at the active level, by using a timer (not shown). If the interval of time exceeds a predetermined length T4, the PD level supervisor 301 sets a PD supervisory flag (not shown) to logical "1" and also outputs a fast interrupt signal FIQ to the CPU 165.

Next, the operation of the ECU 160 in FIG. 3 will be described with reference to the timing diagram shown in FIG. 4.

The operation before the ignition switch 120 is turned on is the same as in the first embodiment. That is, the ECU 160 operates in the power-down mode, performing only a limited set of operations while other operations are halted.

When the operator turns on the ignition switch 120 (at time T1 in FIG. 4), the IG1 signal is sent to the CPU 165 as in the first embodiment, and the operating mode of the ECU 160 is switched from the power-down mode to the normal mode. The PD signal is thereby set to the inactive level (high), the oscillator 167 starts to output the clock signal XTAL, and the reset signal RST is released after a predetermined time.

After a certain time elapses from when the starter motor starts to operate, cranking is performed and the battery voltage drops temporarily (see T2 in FIG. 4) as in the first embodiment.

When the battery voltage drops, there is a possibility that the battery voltage detector 162 may set the PD signal to the active level (low) even though the engine is not stopped. In the second embodiment, however, the PD signal is input only to the PD level supervisor 301.

When the PD signal is set to the active level, the PD level supervisor 301 measures the interval of time for which the PD signal remains at the active level, by using its internal timer. If this interval of time exceeds a predetermined length T4, the PD level supervisor 301 sets the internal PD supervisory flag to logical "1" and generates a fast interrupt request (FIQ). If the PD signal returns to the inactive level within the predetermined length of time T4, then the PD level supervisor 301 stops the timer without generating an interrupt request. In the example shown in FIG. 4, since the battery voltage drop is caused by cranking, the PD signal returns to the inactive level within time T4, the PD supervisory flag is not set, and the fast interrupt signal (FIQ) remains at the inactive level (high) without being activated as it was in the first embodiment.

As in the first embodiment, if the FIQ signal is set to the active level, the CPU 165 reads the PD supervisory flag value from the PD level supervisor 301. If the flag value is a logical "1", the CPU 165 decides that the engine has been stopped and switches to the power-down mode of operation. If the flag value is a logical "0", the CPU 165 remains in the normal mode.

Figure 4:
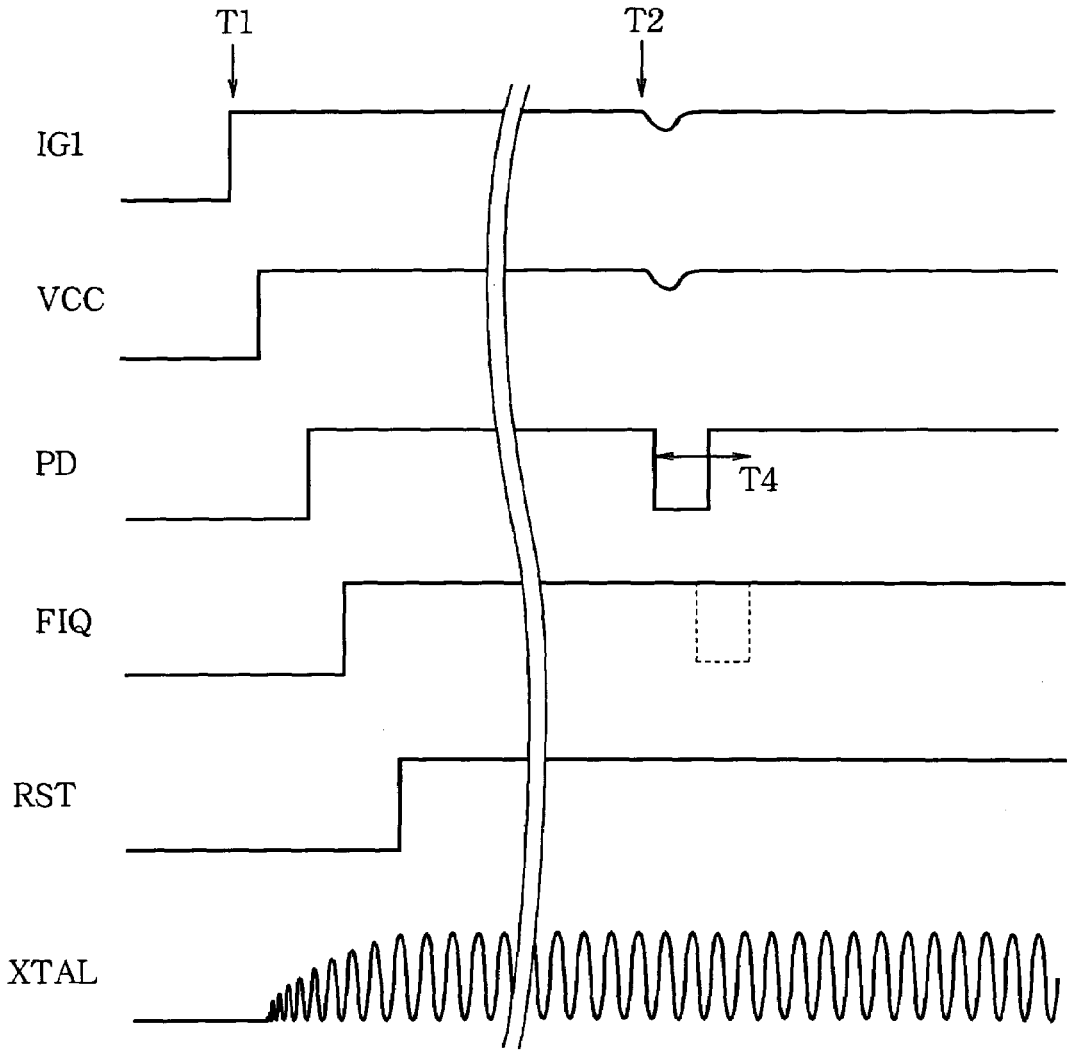
FIG. 4 is a timing diagram illustrating the operation of the second embodiment.

In the example in FIG. 4, the CPU 165 does not receive an active FIQ signal, so it does not check the PD supervisory flag, and simply remains in the normal mode.

As in the first embodiment, the ECU 160 in the second embodiment will not enter the power-down mode by mistake when the battery voltage drops temporarily.

In the first embodiment, since the PD signal is input directly to the FIQ terminal of the CPU 165, while the PD signal remains at the active level the CPU 165 continuously checks the PD supervisory flag and for that reason may not have time to serve other interrupt requests (for example, interrupt requests due to IRQ input). In contrast, in the second embodiment, since the FIQ input to the CPU 165 occurs only after the PD signal has remained continuously active for a time long enough to indicate that the power-down mode may be entered, the CPU 165 is free to serve other interrupt requests while waiting for this time to elapse.

The CPU 165 in the second embodiment operates in the same way as in the first embodiment, reading the PD supervisory flag after the FIQ signal has been set to the active level, in order to make doubly certain that a switchover to the power-down mode is justified. This scheme provides a high level of immunity from noise on the FIQ signal line.

In a variation of the second embodiment, however, the CPU 165 switches the operating mode to the power-down mode as soon as the FIQ signal is set to the active level, without checking the PD supervisory flag.

Those skilled in the art will recognize that further variations are possible within the scope of the invention, which is defined in the appended claims.

What is claimed is:

1. An engine control circuit that switches between a normal mode and a power-down mode according to a battery voltage output by a battery for operating the engine, comprising:

a battery voltage detector setting a detection signal to the active level when the battery voltage is below a predetermined voltage and to the inactive level when the battery voltage is above the predetermined voltage;

a signal supervisor measuring an interval of time for which the detection signal remains continuously at the active level;

and a processor maintaining the normal mode before and during the interval of time measured by the signal supervisor, switching to the power-down mode when the interval of time measured by the signal supervisor reaches a predetermined length, and continuing to maintain the normal made if the interval of time measured by the signal supervisor fails to reach the predetermined length.

2. The engine control circuit of claim 1, wherein: the signal supervisor sets a supervisory flag when the interval of time measured by the signal supervisor reaches the predetermined length; and the processor receives the detection signal as an interrupt signal, reads the supervisory flag when the detection signal is at the active level, and switches to the power-down mode if the supervisory flag is set.

3. The engine control circuit of claim 2, wherein the processor receives the detection signal as a hardware interrupt signal.

4. The engine control circuit of claim 1, wherein: the signal supervisor sends the processor an interrupt signal when the interval of time measured by the signal supervisor reaches the predetermined length; and the processor responds to the interrupt signal by switching to the power-down mode.

5. The engine control circuit of claim 4, wherein the interrupt signal is a hardware interrupt signal.

6. The engine control circuit of claim 4, wherein the processor also responds to the interrupt signal by reading the supervisory flag and switches to the power-down mode only if the supervisory flag is set.

7. The engine control circuit of claim 1, wherein the engine is an automobile engine.

* * * * *